US005919343A

United States Patent [19]

Sparapani

[11] Patent Number: 5,919,343

[45] Date of Patent: Jul. 6, 1999

[54] CATHODE BLANK FOR COPPER PLATING

[75] Inventor: Richard Allen Sparapani, Iron Mountain, Mich.

[73] Assignee: Customer Metal Fabrication, Inc., Iron Mountain, Mich.

[21] Appl. No.: 09/166,601

[22] Filed: Oct. 5, 1998

Related U.S. Application Data

[63] Continuation-in-part of application No. 08/990,859, Dec. 15, 1997, abandoned.

[51] Int. Cl.[6] ..... C25B 11/00

[52] U.S. Cl. ..... 204/286; 204/279; 204/297 R; 29/825; 29/879

[58] Field of Search ..... 204/286, 279, 204/288, 297 R; 29/825, 879

[56] References Cited

U.S. PATENT DOCUMENTS

| | | | |
|---|---|---|---|
| 4,186,074 | 1/1980 | Perry | 204/286 |
| 4,288,313 | 9/1981 | Bormke et al. | 204/286 |
| 5,314,600 | 5/1994 | Webb et al. | 204/279 |
| 5,492,609 | 2/1996 | Assenmacher | 204/286 |

*Primary Examiner*—Bruce F. Bell

*Attorney, Agent, or Firm*—Fasth Law Offices; Rolf Fasth

[57] ABSTRACT

The cathode blank for copper plating has a solid copper hanger bar that has a flat undersurface with end portions adapted to rest upon supports and electrical contacts. A stainless steel sheet has an upper edge that is attached to the copper hanger bar with oversized pins. The stainless steel sheet may also be welded to the copper hanger bar. The stainless steel sheet extends perpendicularly from the undersurface. Plastic strips are attached to the vertical edges of the stainless steel sheet with plastic pins that are plastic welded thereto.

11 Claims, 3 Drawing Sheets

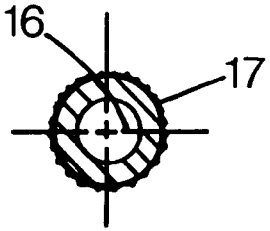
FIG. 7
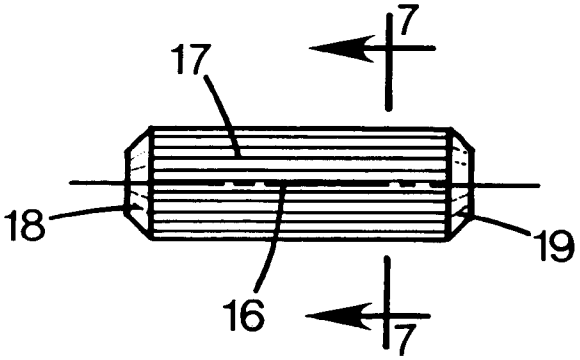
FIG. 6
FIG. 8
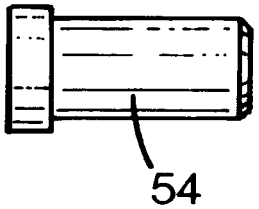

CATHODE BLANK FOR COPPER PLATING

PRIOR APPLICATION

This is a continuation-in-part application of U.S. patent application Ser. No. 08/990,859 filed on Dec. 15, 1997 now abandoned.

TECHNICAL FIELD

The invention relates to an apparatus and method for plating copper onto a stainless steel material that is attached to a solid copper bar.

BACKGROUND INFORMATION AND SUMMARY OF THE INVENTION

The use of cathodes for making copper has been prevalent for many decades. Prior art cathodes often consist of a copper hanger bar, a copper starter sheet, and a pair of copper loops by which the sheet is hung on the bar. The end portions of the bar project beyond the width of the sheet so that they may rest, for support, on the cell sides with one making the usual electrical contact, and with the starter sheet between a pair of anode plates of unrefined copper, both being immersed in the electrolyte of a refining cell, or between a pair of insoluble anodes both immersed in the electrolyte of an electro-winning cell.

The prior art cathodes are deficient in many ways. For example, the copper starter sheets are not re-usable. In other words, they cannot be stripped of the copper deposited on them and then be put back in the cell to receive a fresh copper deposit. The present and most economical practice is to melt the starter sheet copper, along with the copper deposited on it, and, from the melt, to produce wire bars, rods, billets, and other copper stock commodities in a marketable condition. Only a fraction of the melt output can be used for making fresh starter sheet, and it has been shown that it is more economical to produce fresh starter sheets electrolytically. However, the man-hour expenditure is very high because it involves stripping of starter sheets from the mother plates, flattening of the sheets, making and attaching the loops.

Another drawback with copper starter sheets is that they are not easily made truly flat, and they frequently warp in service that may give rise to short circuiting between the cathode and the anode. Short circuiting is a serious problem because it requires having the staff spending time on patrolling the tank house to remedy short circuits.

Furthermore, the loops sometimes make just a point or line contact with the support bar. This does not impair the actual copper deposit process, but it does increase resistance, and consequently, power costs are increased.

The cathode of the present invention solves some of the above-listed problems. The cathode has a solid copper hanger bar that has a flat undersurface with end portions adapted to rest upon supports and electrical contacts. A stainless steel sheet has an upper edge that is attached to the copper hanger bar with over-sized pins so that the steel sheet extends perpendicularly from the undersurface. The stainless steel sheet may also be welded to the copper hanger bar. Plastic strips may be attached to the vertical side edges of the stainless steel sheet with plastic pins that are plastic welded thereto.

BRIEF DESCRIPTION OF THE DRAWINGS

FIG. 6 is a side view of knurled steel pin of the present invention;

FIG. 7 is a cross-sectional view along line 6—6 of FIG. 6;

FIG. 8 is a side view of a plastic pin of the present invention;

DETAILED DESCRIPTION

Figure 2:
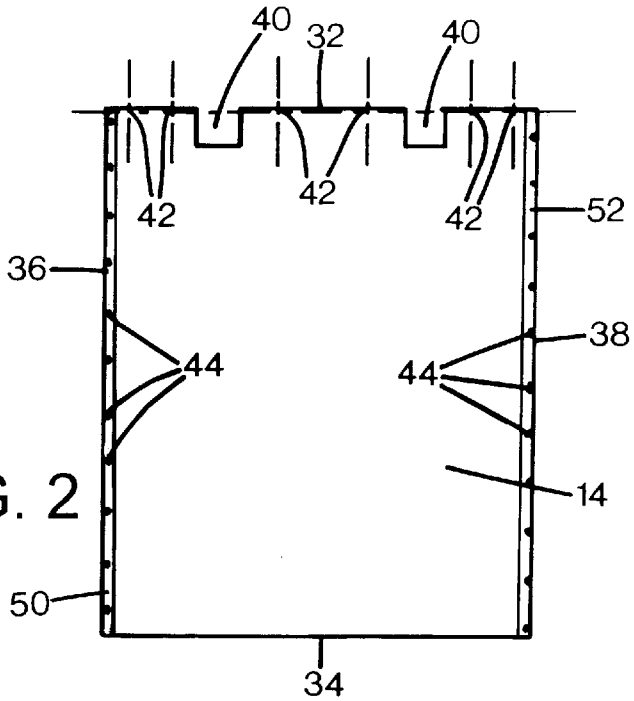
FIG. 2 is a detailed front side view of the stainless steel sheet of the present invention.
Figure 3:
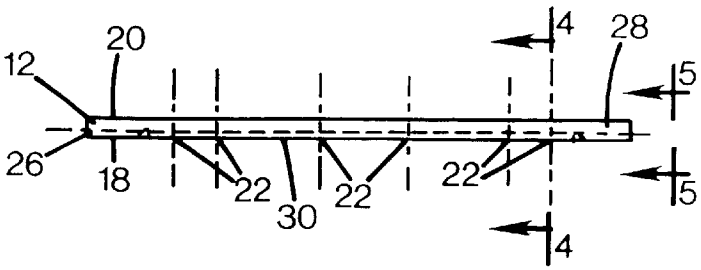
FIG. 3 is a side view of the hanger bar of the present invention.
Figure 5:
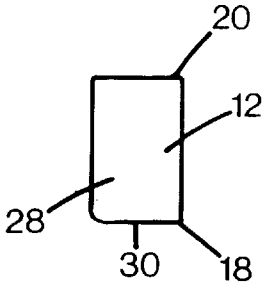
FIG. 5 is an end view along line 5—5 of FIG. 3.
Figure 4:
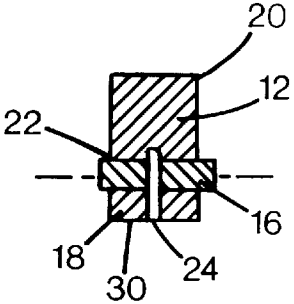
FIG. 4 is a cross-sectional view along line 4—4 of FIG. 3.
Figure 1:
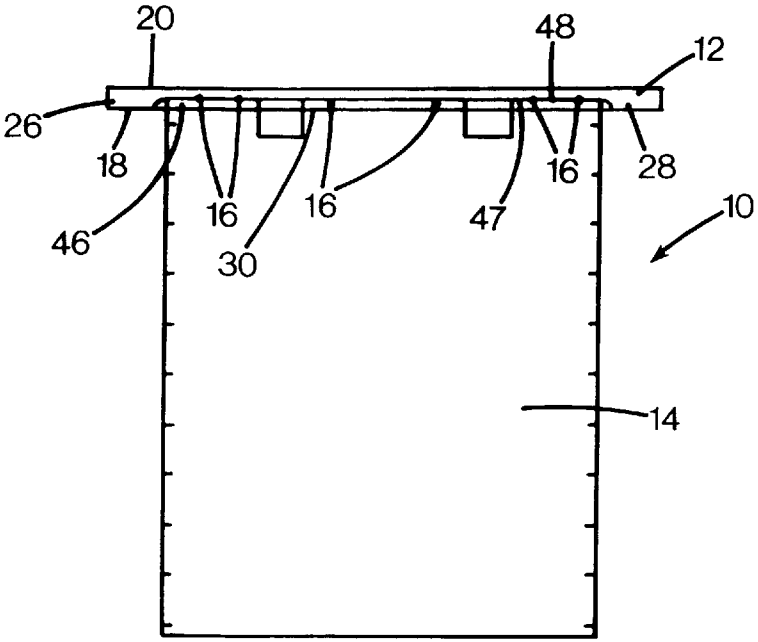
FIG. 1 is a front side view of the cathode blank of the present invention.

With reference to FIGS. 1–10, a cathode blank 10 of the present invention includes an elongate solid copper hanger bar 12 that is attached to a flat stainless steel sheet 14. As explained in detail below, the sheet 14 may be attached to the hanger bar 12 by pins 16 or be plasma transfer arc welded to the hanger bar 12.

The hanger bar 12 is preferably made of solid copper because the material provides excellent electrical conductivity and the ability to withstand corrosion and mechanical drainage. Preferably, a C 110 H04 type of copper is used. The hanger bar 12 preferably has a rectangular cross section and has an underside 18 and an upper side 20. The hanger bar 12 may be about 51 3/16" long, 1.5" high and about 1" wide. It should be understood that the hanger bar may have any other suitable shape and size.

Adjacent the underside 18, the hanger bar 12 has a plurality of horizontal openings 22 defined therein that extend through the hanger bar 12. The openings 22 may have an inner diameter that is about 0.302". The openings 33 are disposed about 4" and 8" apart along the hanger bar 12. The openings 22 are dimensioned to tightly hold the pins 16. The hanger bar 12 also defines a longitudinal vertical slot 24 that extends from one end of the hanger bar 12 to the opposite end of the hanger bar 12. The slot 24 extends from a bottom surface 30 of the underside 18 and passed the horizontal openings 22. The slot 24 is about 0.75" deep. However, the slot 24 does not longitudinally extend through the support portions 26, 28 that are disposed at each end of the hanger bar 12. The slot 24 may be about 40–41" long so that it represents about 80% of the length of the hanger bar 12. The slot may have a width that is about 0.125" to be able to receive an 11 gauge sheet, as described in detail below. The bottom surface 30 is slightly rounded at each support portion 26, 28 so that the center of gravity of the hanger bar 12 is such that the hanger bar hangs straight down. The support portions 26, 28 are adapted to rest on support and electrical contacts.

The sheet 14 has a substantially square shape. The sheet is about 43.313" high and about 39.375" wide so that the width of the sheet 14 is slightly less than the length of the slot 24. The sheet 14 has an upper end 32, a lower end 34 and vertical side edges 36, 38. The sheet 14 preferably has a pair of holes 40 defined at the upper end 32. These holes 40 facilitate mass handling of a number of the cathodes by support rods or springs extended through the holes 40. The upper end 32 also has a plurality of openings 42 defined therein. The openings are drilled about 4" and 8" apart. An important feature is that the openings 42 may be aligned with the openings 22 of the hanger bar 13. A plurality of openings 44 may be defined along both side ends 36, 38. The purpose of these openings 44 is to receive plastic pins that hold masking means along the side edges of the sheet 14 to prevent copper plating along the side edges 36, 38. In the preferred embodiment of the present invention, plastic strips 50, 52 are attached to the side edges 36, 38, respectively.

Figure 9:
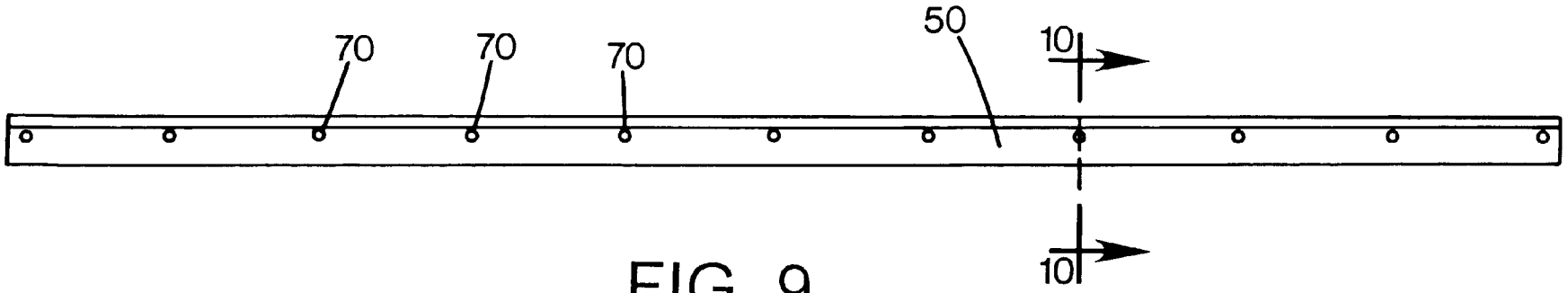
FIG. 9 is a top view of the edge strip of the present invention.
Figure 10:
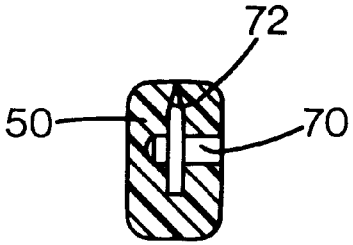
FIG. 10 is a view along line 9—9 in FIG. 9.

A detailed view of a plastic strip 50 (which is identical to strip 52) is shown in FIG. 9. The plastic strip 50 is about 41.5" long and about 1" wide. The plastic strip 50 is preferably made of CPVC polymer but other suitable materials may also be used. The plastic strip 50 has a plurality of holes defined therein. In the preferred embodiment, the strip 50 has about eleven holes that are spaced about 4" from one another. As best seen in FIGS. 9 and 10, the strip 50 has a plurality of openings 70 and an openable groove 72 is defined along the strip 50 for receiving one of the side edges 36, 38 of the stainless steel sheet 14. The openings 70 do not extend through the strip 50 to prevent the electrolytic solution from getting in contact with the back side of the side edges of the sheet 14.

The plastic strip 50 may be attached to the side edge 36 by eleven CPVC pins 54 that are inserted into the openings 70 of the strip 50 and the holes 44 of the stainless steel sheet 14 to hold the strip 50 to the sheet 14. It is to be understood that the pins may be made of any suitable material and that any suitable number of pins 54 may be used.

More particularly, the plastic strips may be secured to the edge strips, 36, 38 by ultrasonic plastic welder. The plastic welding technique reduces the growth of copper nodules on the pin locations. The nodes are undesirable because they may create short circuits in the cells and require a machine operator to chisel the nodules of the plastic strips which may cause damage to the strips and add cost of the manufacturing. The growth of nodules also shortens the lifetime of the plastic strips. The plastic welding is better than gluing the pins into the plastic strips because the welds provide a 100% seal of the pins 54 to the strips 50, 52.

A wide range of stainless steels may be used for the sheet 14. Preferably, the stainless steels should have a 316L 2B finish or better as per specification ASTM A240. The thickness of the sheet should be about 11 gauge. In the preferred embodiment, the steel has about 0.03% by weight carbon, 12.0% by weight nickel, 17.0% by weight chromium and about 2.25% by weight molybdenum. The 2B surface finish is intermediate bright and dull, being a silvery-grey, semi-bright surface produced by cold rolling, softening and de-scaling, and then final rolling lightly with polished rolls.

The preferred steel and surface finish provide sufficient tenacity of attachment between the sheet 14 and the copper deposited thereon to prevent the copper from peeling or slumping from the sheet 14 on its own accord. However, this tenacity is not such as to impede ready stripping of the copper from the sheet 14. Stripping may be performed by use of knife-like blades or knife-edge wedges inserted between the sheet 14 and the deposited copper at the upper edge of the copper.

The step of copper stripping often requires effective masking of the sheet edges so that the deposit of copper will not be continuous about those edges. This is particularly important at the upright side edges of the sheet 14. The lower end 34 at the bottom edge is preferably masked. To provide for clean stripping, it is desirable to mask the lower end 34 merely by giving it a hot dip to a depth of about an inch of a high melting point resilient wax or other masking material. The lower end 34 may be about ¾" wide from the bottom of the sheet 14. Prior to applying the wax, it may be necessary to disc buff the lower end 34 of the sheet 14.

Regarding the masking of the side edges of the sheet 14, the sheet shows a further important advantage compared to, for example, titanium sheets. The relatively high conductivity of titanium, there is a proneness for creep of deposit copper particles under the masking strip material. Once that happens, copper nodules continue to grow under the mask strip thus tending to lift the strip and so defeat the reason for masking and also create the need for re-masking before further use.

With steel sheets, the relatively poor conductivity discourages copper growth under the masking means and such growth is thereby reduced to such a degree as to become inconsequential. Notwithstanding, it is desirable to effectively mask at least the side edges of the steel sheet. As mentioned above, the masking means may comprise the longitudinally slotted plastic strips 50, 52 that are sealingly held on to the sheet 14 by the plastic pins 54. These pins extend through the holes 44 that are defined in the sheet 14. The diameter of the holes 44 is quite larger than the diameter of the pins 54 to eliminate or at least reduce any shearing of the pins 54. For example, the holes 44 may have an inner diameter that is about 0.302" and the other diameter of the pins 54 may be about 0.234" at the lower end portion thereof. The head of the pins 54 may have an outer diameter that is about 0.290". The pins 54 may shear due to the difference between the expansion and contraction coefficients between the plastic strips 50, 52 and the sheet 14. The expansion of the sheet 14 occurs when the sheet 14 is lowered into the electrolytic solution having a temperature of about 140° C. and the contraction occurs when the sheet 14 is pulled out of the electrolytic solution into room temperature. The larger diameter of the holes 44 reduces the shearing forces on the pins 54 extending therethrough.

As mentioned above, the sheet 14 is held to the hanger bar 12 by pins 16. The pins 16 may be made of 316 stainless steel and be about 1" long and have a diameter of about 0.328" that is about 0.030" larger than the hole diameter of the openings 22, 42 of the copper bar 12 and the sheet 14, respectively. The pins 16 preferably have a knurled outer surface 17, as best shown in FIG. 7 and chamfered ends 19, as best shown in FIG. 6.

The sheet 14 may be attached to the hanger bar 12 by inserting the sheet into the slot 24 so that the openings 42 are aligned with the openings 22 defined in the hanger bar 12. The pins 16 are then pressed through both openings 22, 42 to firmly hold the sheet 14 to the hanger bar 12. Because the outer diameter of the pin 16 is greater than the openings 22, 42 and 10-ton press is needed to drive the pin 16 through both the hanger bar 12 and the sheet 14. It has been found that this difference in diameter, along with the press fit design, significantly improves the electrical connection between the hanger bar 12, the sheet 14 and the pins 16.

In the event that a hanger bar 12 or a sheet 14 is damaged so that their openings are larger, the pins 16 may be pressed out and replaced with pins having a larger diameter than the pins 16 so that the enlarged replacements pins are be pressed into the enlarged openings. In this way, even slightly damaged hanger bars or sheets may continued to be used with cost saving of about 30–35% to the user.

To avoid copper plating at the upper end 32 of the sheet 14, an edge strip 46 may beheld to the sheet 14 by the pins 16. An important advantage of the present invention is that the copper hanger bar 12 may be re used several times although the sheet is damaged due to scratches or warpage. A new sheet is simply attached to the hanger bar with the pins. This may not be possible if the sheet is welded to the hanger bar.

A sealant 48 may be used to seal the area between the sheet 14 and the underside of the hanger 12. For example, Dow Corning π832 may be used to reduce and even eliminate corrosion that may occur between the sheet 14, pins 16 and the hanger bar 12.

The sheet 14 may also be welded to the hanger bar 12 by a plasma transfer arc welding process to create a weld 47. This type of welding process is particularly useful when a welded overlay is required and porosity must be non-existent. This welding technique uses argon as a shield gas and a tungsten electrode. The plasma transfer arc welding process may eliminate the need for using pins. Additionally, there may be no need for a sealant. It takes only about 90 seconds to weld the sheet to the hanger bar compared to about 1½ hours using conventional welding processes. Both the copper hanger bar and the sheet 14 are first cleaned and de-greased. A flux material, such as Eutector Flux 157, may be applied to the seam area.

In the alternative, Eutecrod 157 or Staintin 157 PA may be applied to the seam area instead of Eutector Flux 157. The area to be welded is then heated to allow the alloy to flow and fill the seam area. Preferably, any flux residue is washed from the sheet and the hanger bar. The dry and clean seam area is then abrasive blasted. The sheet and the hanger bar are then preheated to about 180° F. A coating of Evertuff ET-13 Clear is applied by using one of the Terodyn thermal spray systems to seal the seam area. In the alternative, a coating of Evertuff ET-13 Clear may be applied without applying the Eutector Flux 157 and heat the seam and wash off any flux residue from the seam area.

In operation of the cathode blank, after copper has been deposited on the sheet 14, the sheet is passed through a flexing station to bend the sheet so that the deposited copper will fall loose off the sheet 14. The sheet 14 can then be transferred back to the tanks to be re-used to produce more cathode copper. It has been found that the cathode blank 10 of the present invention produces about 12% more copper per side of the sheet 14 compared to the prior art techniques due partly to the higher conductivity of the hanger bar 12.

While the present invention has been described in accordance with preferred compositions and embodiments, it is to be understood that certain substitutions and alterations may be made thereto without departing from the spirit and scope of the following claims.

I claim:

1. A cathode blank for copper plating, comprising:

a copper hanger bar having an undersurface with end portions adapter to rest upon support members and electrical contacts, the copper hanger bar having a first opening defined therein, the first opening having a first inner diameter;

a stainless steel sheet having an upper edge, the stainless steel sheet having a second opening defined therein, the second opening having a second inner diameter; and a pin member having an outer diameter, the pin member being driven through the first opening and the second opening to firmly attach the stainless steel sheet to the copper hanger bar so that the stainless steel sheet extends perpendicularly from the flat undersurface, the outer diameter being greater than the first and second inner diameters.

2. The cathode blank according to claim 1 wherein the copper hanger bar has a longitudinal slot defined therein, the longitudinal slot has a width that is dimensioned to receive the upper edge of the stainless steel sheet.

3. The cathode blank according to claim 1 wherein an edge strip is attached to the upper edge of the stainless steel sheet.

4. The cathode blank according to claim 1 wherein a sealant is disposed at the upper edge of the stainless steel sheet to seal both the stainless steel sheet and the hanger bar.

5. The cathode blank according to claim 1 wherein the first opening of the copper hanger bar is in fluid communication with the slot of the stainless steel sheet when the stainless steel sheet is fully inserted into the slot.

6. The cathode blank according to claim 1 wherein the copper hanger bar is made from solid copper.

7. A cathode blank for copper plating, comprising:

a copper hanger bar having an undersurface with end portions adapter to rest upon supports and electrical contacts, the copper hanger bar defining a set of first openings having a first inner diameter;

a stainless steel sheet having an upper edge, the upper edge defining a set of second openings having a second inner diameter;

a knurled pin having an outer diameter, the outer diameter being greater than the first inner diameter and the second inner diameter, the knurled pin being pressed into the first and second openings to attach the knurled pin to the stainless steel sheet and to the copper hanger bar.

8. The cathode blank according to claim 7 wherein a plastic strip is sealingly attached to the stainless steel sheet with plastic pins.

9. A method of making a cathode blank comprising:

providing a copper hanger bar having an undersurface with end portions, the copper hanger bar having a first opening defined therein and a stainless steel sheet having an upper edge, the stainless steel sheet having a second opening defined therein and a pin member having an outer diameter that is greater than an inner diameter of the first opening and the second opening;

applying a press to a pin member to drive the pin member through the first opening and the second opening to attach the stainless steel sheet to the copper hanger bar at the upper edge so that the stainless steel sheet extends perpendicularly from the undersurface; and attaching a polymeric strip to a vertical edge of the stainless steel sheet.

10. The method according to claim 9 wherein the step of attaching further comprises attaching the polymeric strip to the stainless steel sheet with plastic pins.

11. The method according to claim 10 wherein the method further comprises welding the plastic pins to the plastic strip.

* * * * *